US006494774B1

(12) United States Patent
Zuniga et al.

(10) Patent No.: US 6,494,774 B1
(45) Date of Patent: Dec. 17, 2002

(54) CARRIER HEAD WITH PRESSURE TRANSFER MECHANISM

(75) Inventors: Steven M. Zuniga, Soquel, CA (US); Hung Chih Chen, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/610,559

(22) Filed: Jul. 5, 2000

Related U.S. Application Data

(60) Provisional application No. 60/143,197, filed on Jul. 9, 1999.

(51) Int. Cl.[7] ..... B24B 5/00

(52) U.S. Cl. ..... 451/398; 451/41; 451/288

(58) Field of Search ..... 451/398, 397, 451/288, 287, 285, 41

(56) References Cited

U.S. PATENT DOCUMENTS

| | | | | |
|---|---|---|---|---|
| 4,918,869 | A | 4/1990 | Kitta | |
| 5,193,316 | A | 3/1993 | Olmstead | |
| 5,205,082 | A | 4/1993 | Shendon et al. | |
| 5,423,716 | A | 6/1995 | Strasbaugh | |
| 5,449,316 | A | 9/1995 | Strasbaugh | |
| 5,584,746 | A | * 12/1996 | Tanaka et al. | 451/41 |
| 5,584,751 | A | 12/1996 | Kobayashi et al. | |
| 5,624,299 | A | 4/1997 | Shendon | |
| 5,643,053 | A | 7/1997 | Shendon | |
| 5,643,061 | A | 7/1997 | Jackson et al. | |
| 5,759,918 | A | 6/1998 | Hoshizaki et al. | |
| 5,803,799 | A | 9/1998 | Volodarsky et al. | |
| 5,851,140 | A | 12/1998 | Barns et al. | |
| 5,879,220 | A | 3/1999 | Hasegawa et al. | |
| 5,957,751 | A | 9/1999 | Govzman et al. | |
| 5,964,653 | A | 10/1999 | Perlov et al. | |
| 6,080,050 | A | 6/2000 | Chen et al. | |
| 6,132,298 | A | 10/2000 | Zuniga et al. | |
| 6,146,259 | A | 11/2000 | Zuniga et al. | |
| 6,159,079 | A | 12/2000 | Zuniga et al. | |
| 6,162,116 | A | 12/2000 | Zuniga et al. | |
| 6,165,058 | A | 12/2000 | Zuniga et al. | |
| 6,183,354 | B1 | 2/2001 | Zuniga et al. | |
| 6,210,255 | B1 | 4/2001 | Zuniga et al. | |
| 6,220,944 | B1 * | 4/2001 | Chen | 451/285 |

FOREIGN PATENT DOCUMENTS

| | | |
|---|---|---|
| EP | 0 841 123 | 5/1998 |
| JP | 2243263 | 9/1990 |
| WO | WO 99/07516 | 2/1999 |

* cited by examiner

*Primary Examiner*—Eileen P. Morgan
*Assistant Examiner*—Hadi Shakeri
(74) *Attorney, Agent, or Firm*—Fish & Richardson

(57) ABSTRACT

A carrier head with a housing, a lower flexible membrane that defines a first chamber, an upper flexible membrane that defines a second chamber, and a pressure distribution assembly positioned between the upper flexible membrane and the lower flexible membrane. A lower surface of the lower flexible membrane provides a substrate mounting surface, and a portion of the upper flexible membrane can be biasable into contact with an upper surface of the lower flexible membrane. The pressure distribution assembly can include an upper surface in contact with the upper flexible membrane and a lower surface in contact with the lower flexible membrane. The pressure distribution assembly can be configured to transfer pressure from a portion of the upper flexible membrane to a more concentrated region of the substrate.

24 Claims, 7 Drawing Sheets

20
68
76
72
100
70
74
60
10
66
62
64
52
32
30
25
40
50
27

CARRIER HEAD WITH PRESSURE TRANSFER MECHANISM

CROSS-REFERENCE TO RELATED APPLICATION

This application claims priority to Provisional U.S. Application Serial No. 60/143,197, filed Jul. 9, 1999, the entirety of which is incorporated herein by reference.

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface can present problems in the photolithographic steps of the integrated circuit fabrication process. Therefore, there is a need to periodically planarize the substrate surface. In addition, plaranization is needed when polishing back a filler layer, e.g., when filling trenches in a dielectric layer with metal.

Chemical mechanical polishing (CMP) is one accepted method of planarization. This planarization method typically requires that the substrate be mounted on a carrier or polishing head. The exposed surface of the substrate is placed against a rotating polishing pad. The polishing pad may be either a "standard" or a fixed-abrasive pad. A standard polishing pad has a durable roughened or soft surface, whereas a fixed-abrasive pad has abrasive particles held in a containment media. The carrier head provides a controllable load on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate. A polishing slurry, including at least one chemically-active agent, and abrasive particles if a standard pad is used, is supplied to the surface of the polishing pad.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

A reoccurring problem in CMP is non-uniform polishing. Due to a variety of factors, some portions of the substrate tend to be polished at a different rate than other parts of the substrate. This non-uniform polishing can occur even if a uniform pressure is applied to the backside of the substrate. In addition, a substrate arriving at the polishing apparatus may have an initial thickness that is non-uniform. Therefore it is desireable to provide a carrier head that can apply different pressures to different regions of the substrate during chemical mechanical polishing to compensate for non-uniform polishing rates or for non-uniform initial thickness of the substrate.

SUMMARY

In one aspect, the invention is directed to a carrier head that has a housing, an upper flexible membrane coupled to the housing to define an upper pressurizable chamber, and a pressure distribution assembly positioned below the upper flexible membrane. The pressure distribution assembly transfers pressure from a portion of the upper flexible membrane to a more concentrated region of a substrate.

Implementations of the invention may include one or more of the following features. The pressure distribution assembly may include a disk-shaped plate, an annular ring, or a disk-shaped plate and an annular ring surrounding the disk-shaped plate. The carrier head may include a lower flexible membrane having a substrate mounting surface. Both the upper flexible membrane and the pressure distribution assembly may contact an upper surface of the lower flexible membrane. The pressure distribution assembly may include a rigid member to contact the upper flexible membrane and a cushion positioned below the rigid member. The surface area of the lower surface of the cushion may be less than the surface area of the upper surface of the rigid member. The carrier head may include an edge load ring to contact a perimeter portion of the substrate.

In another aspect, the invention may be directed to a carrier head that has a housing, a lower flexible membrane coupled to the housing to define a first chamber, an upper flexible membrane coupled to the housing to define a second chamber, and a pressure distribution assembly positioned between the upper flexible membrane and the lower flexible membrane. A lower surface of the lower flexible membrane provides a substrate mounting surface, and a portion of the upper flexible membrane is biasable into contact with an upper surface of the lower flexible membrane. The pressure distribution assembly includes an upper surface in contact with the upper flexible membrane and a lower surface in contact with the lower flexible membrane.

Implementations of the invention may include one or more of the following features. The pressure distribution assembly may be configured to transfer pressure from a portion of the upper flexible membrane to a more concentrated region of the lower flexible membrane. The pressure distribution assembly may includes a disk-shaped plate, an annular ring, or a disk-shaped plate and an annular ring surrounding the disk-shaped plate. The pressure distribution assembly may include a rigid member to contact the upper flexible membrane, and a cushion positioned below the rigid member to contact the lower flexible membrane. The carrier head may include an edge load ring to contact a perimeter portion of the substrate.

Potential advantages of implementations of the invention may include the following. The distribution of pressure on the substrate may be controlled. Both the pressure and the loading area of the flexible membrane against the substrate may be varied to compensate for non-uniform polishing. The carrier head may be able to either increase or decrease the pressure at the substrate center relative to the pressure on other portion of the substrate. Non-uniform polishing of the substrate may be reduced, and the resulting flatness and finish of the substrate may be improved. The carrier head may be useful in a variety of polishing procedures.

Other advantages and features of the invention will be apparent from the following description, including the drawings and claims.

DETAILED DESCRIPTION

Figure 1:
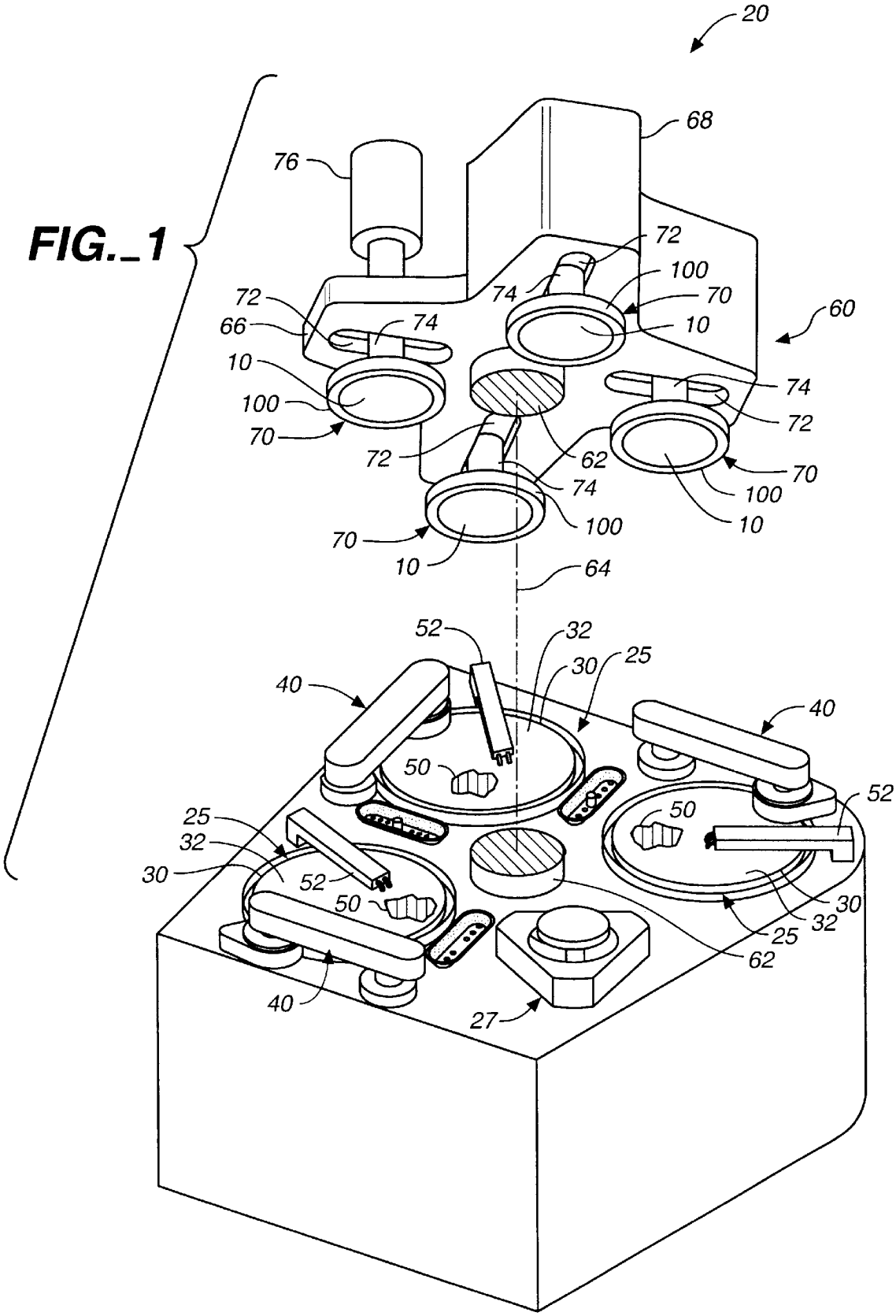
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for loading and unloading the substrates. Each polishing station 25 includes a rotatable platen 30 on which is placed a polishing pad 32. Each polishing station 25 may further include an associated pad conditioner apparatus 40 to maintain the abrasive condition of the polishing pad.

A slurry 50 containing a chemically active agent (e.g., deionized water for oxide polishing) and a pH adjuster (e.g., potassium hydroxide for oxide polishing) may be supplied to the surface of the polishing pad 32 by a combined slurry/rinse arm 52. If the polishing pad 32 is a standard pad, the slurry 50 may also include abrasive particles (e.g., silicon dioxide for oxide polishing). Typically, sufficient slurry is provided to cover and wet the entire polishing pad 32. The slurry/rinse arm 52 includes several spray nozzles (not shown) to provide a high pressure rinse of the polishing pad 32 at the end of each polishing and conditioning cycle.

A rotatable multi-head carousel 60 is supported by a center post 62 and rotated thereon about a carousel axis 64 by a carousel motor assembly (not shown). The multi-head carousel 60 includes four carrier head systems 70 mounted on a carousel support plate 66 at equal angular intervals about the carousel axis 64. Three of the carrier head systems position substrates over the polishing stations, and one of the carrier head systems receives a substrate from and delivers the substrate to the transfer station. The carousel motor may orbit the carrier head systems, and the substrates attached thereto, about the carousel axis between the polishing stations and the transfer station.

Each carrier head system 70 includes a polishing or carrier head 100. Each carrier head 100 independently rotates about its own axis, and independently laterally oscillates in a radial slot 72 formed in the carousel support plate 66. A carrier drive shaft 74 extends through the slot 72 to connect a carrier head rotation motor 76 (shown by the removal of one-quarter of a carousel cover 68) to the carrier head 100. Each motor and drive shaft may be supported on a slider (not shown) which can be linearly driven along the slot by a radial drive motor to laterally oscillate the carrier head 100.

During actual polishing, three of the carrier heads are positioned at and above the three polishing stations. Each carrier head 100 lowers a substrate into contact with the polishing pad 32. The carrier head 100 holds the substrate in position against the polishing pad and distributes a force across the back surface of the substrate. The carrier head 100 also transfers torque from the drive shaft 74 to the substrate.

Figure 2A:
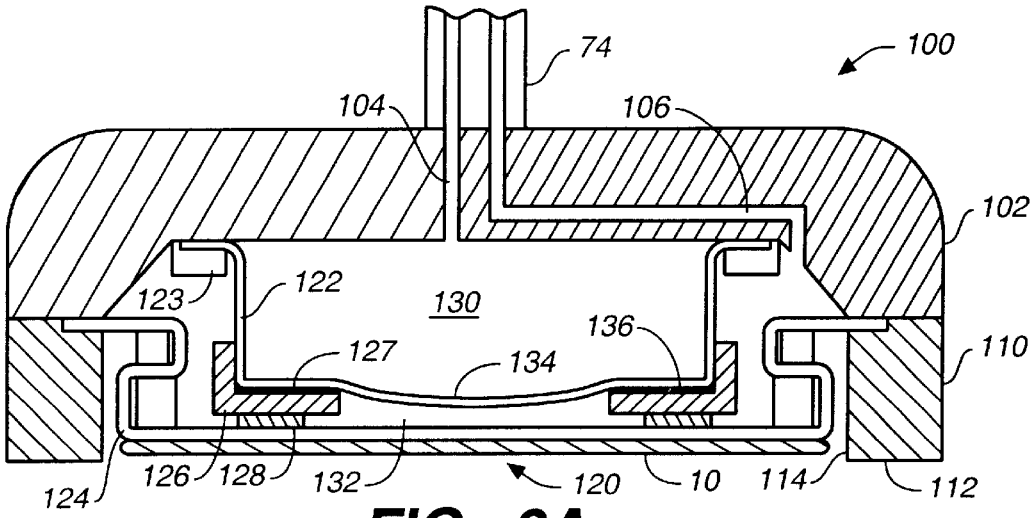
FIG. 2A is a schematic cross-sectional view of a carrier head according to the present invention.

Referring to FIG. 2A, the carrier head 100 includes a housing 102, a retaining ring 110, and a substrate backing assembly 120 which includes two pressurizable chambers, such as an internal chamber 130 and an external chamber 132. Although unillustrated, the substrate backing assembly can be suspended from a base assembly, and the base assembly can be connected to the housing by a separate loading chamber that controls the pressure of the retaining ring on the polishing surface. In addition, the carrier head can also include other features, such as a gimbal mechanism (which may be considered part of the base assembly). A description of a similar carrier head with these features may be found in U.S. patent application Ser. No. 09/470,820, filed Dec. 23, 1999, the entire disclosure of which is incorporated herein by reference.

The housing 102 can be connected to the drive shaft 74 (see FIG. 1) to rotate therewith during polishing about an axis of rotation which is substantially perpendicular to the surface of the polishing pad. The housing 102 may be generally circular in shape to correspond to the circular configuration of the substrate to be polished. Two passages 104, 106 may extend through the housing 102 for pneumatic control of the internal chamber 130 and the external chamber 132, respectively.

The retaining ring 110 may be a generally annular ring secured at the outer edge of the housing 102. A bottom surface 112 of the retaining ring 110 may be substantially flat, or it may have a plurality of channels to facilitate transport of slurry from outside the retaining ring to the substrate. An inner surface 114 of the retaining ring 110 engages the substrate to prevent it from escaping from beneath the carrier head.

Still referring to FIG. 2A, the substrate backing assembly 120 includes an inner membrane 122, an outer membrane 124, and an annular support structure 126. The volume between the housing 102 and the inner membrane 122 forms the internal chamber 130, whereas the volume between the inner membrane 122 and the outer membrane 124 forms the external chamber 132.

The internal and outer membranes 122 and 124 can be formed of a flexible material, such as an elastomer, such as chloroprene or ethylene propylene rubber, or silicone, an elastomer coated fabric, a thermal plastic elastomer (TPE), or a combination of these materials. The bottom surface of a central portion of the inner membrane 122 or the top surface of a central portion of the outer membrane 124 have small grooves to ensure that fluid can flow and/or a textured rough surface to prevent adhesion when the internal and outer membranes are in contact. The outer edge of the inner membrane 122 may be clamped between a clamp ring 123 and the housing 102 to form a fluid-tight seal, whereas the outer edge of the outer membrane 124 may be clamped between the retaining ring 110 and the housing 102 to form a fluid-tight seal.

The support structure 126 can be a generally rigid annular body located inside the external chamber 132. The support structure 126 can have an "L-shaped" cross-section, although many other implementations are possible. The support structure 126 can be affixed to the bottom surface of the inner membrane 122 by an adhesive layer 127. Alternatively, the support structure need not be secured to the rest of the carrier head, and may be held in place by the internal and external flexible membranes. An annular pad or cushion 128, such a piece of carrier film, is secured to a lower surface of the support structure 126.

For a polishing operation, either or both the internal chamber 130 and the external chamber 132 are pressurized, e.g., to pressures $P_{upper}$ and $P_{lower}$, respectively. As shown in FIG. 2A, if the pressure in the internal chamber 130 is sufficiently low (relative to the pressure in the external chamber 132), then the inner membrane 122 does not contact the outer membrane 124. However, an annular middle section 136 of the inner membrane 122 does press downwardly on the annular support structure 126, causing the annular cushion 128 to press downwardly on the upper surface of the outer membrane 124.

Figure 2B:
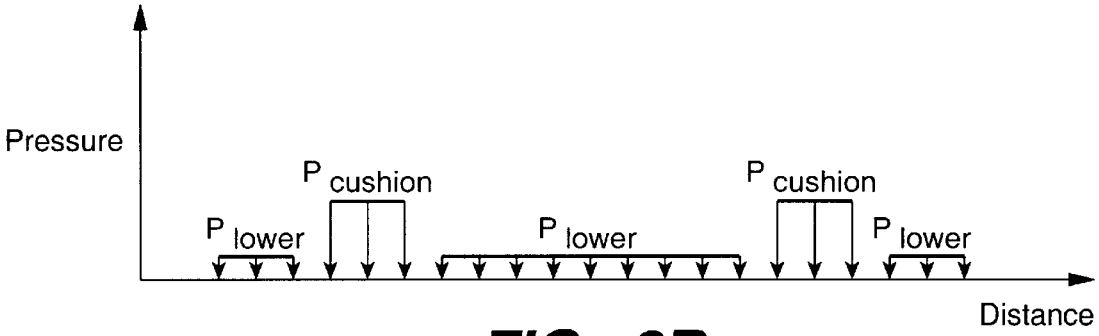
FIG. 2B is graph of an exemplary distribution of pressure on the backside of the substrate from the carrier head of FIG. 2A.
Figure 2C:
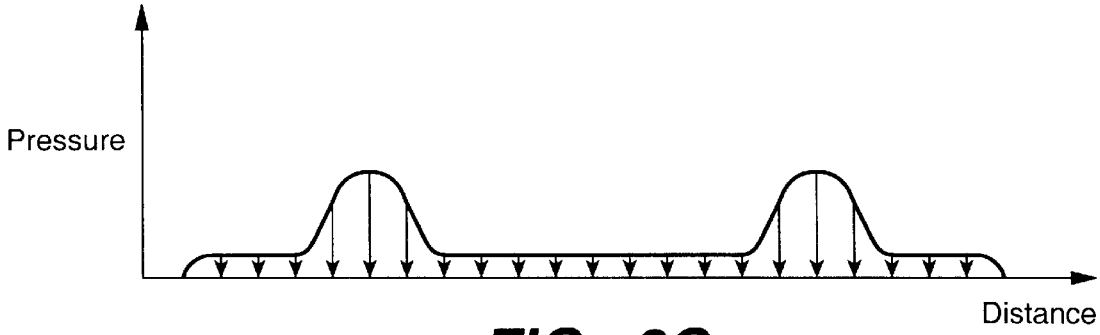
FIG. 2C is graph of an exemplary distribution of pressure on the front surface of the substrate from the carrier head of FIG. 2A.

In this configuration, as shown in FIGS. 2B–2C, a pressure $P_{cushion}$ is applied to an annular middle region of the backside of the substrate where the cushion 128 contacts the outer membrane 124. The pressure $P_{cushion}$ applied by the cushion 128 is given approximately by the following equation:

$$P_{cushion} = \frac{A_{membrane}}{A_{cushion}} \cdot P_{upper}$$

where $A_{membrane}$ is the surface area of the lower section of the inner membrane 122, i.e., the combined surface area of the center portion 134 and the annular portion 136, and $A_{cushion}$ is the surface area of the cushion 128 in contact with the outer membrane 124. The pressure $P_{lower}$ in the external chamber 132 is applied to the remainder of the substrate. Thus, in the configuration of FIGS. 2A–2C, the carrier head 100 can apply different pressures to the substrate in two independent zones, one beneath the cushion, and one for the remainder of the substrate.

Figure 2D:
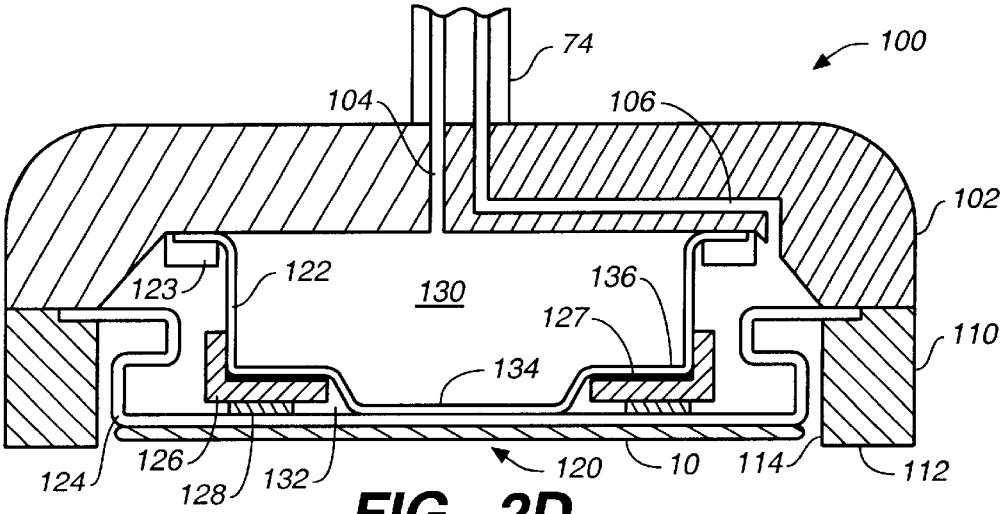
FIG. 2D is a schematic cross-sectional view of the carrier head of FIG. 2A showing the controllable center loading area.
Figure 2E:
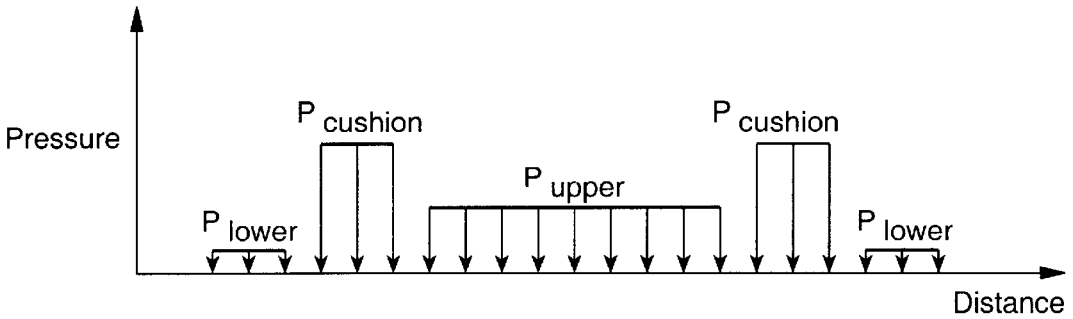
FIG. 2E is graph of an exemplary pressure distribution on the backside of the substrate from the carrier head of FIG. 2D.
Figure 2F:
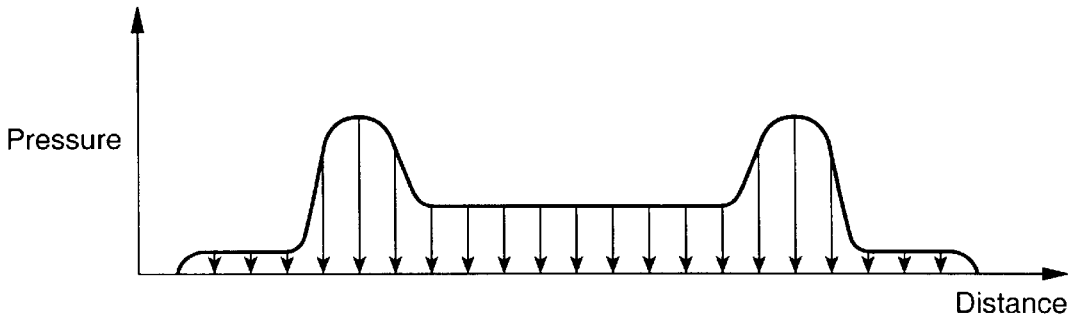
FIG. 2F is graph of an exemplary pressure distribution on the front surface of the substrate from the carrier head of FIG. 2D.

As shown in FIG. 2D, as the pressure in the internal chamber 130 is increased, a central portion 134 of the inner membrane 122 bows downwardly until it contacts the upper surface of the outer membrane 124. The resulting pressure distributions are shown in FIGS. 2E–2F. In the configuration of FIGS. 2D–2E, the carrier head 100 can apply different pressures to three zones of the substrate: one beneath the cushion 128, one where the inner membrane 122 contacts the outer membrane 124, and one for the remainder of the substrate.

Eventually, the pressure in the internal chamber 130 is high enough that the inner membrane 122 engages the outer membrane in virtually all of the available contact area. At and above this pressure, the pressure $P_{cushion}$ applied by the cushion 128 is given approximately by the following equation:

$$P_{cushion} = \frac{A_{plate}}{A_{cushion}} \cdot (P_{upper} - P_{lower})$$

where $A_{plate}$ is the surface area of the support structure 126 in contact with the inner membrane 122 and $A_{cushion}$ is the surface area of the cushion 128 in contact with the outer membrane 124. At pressures between the critical pressure at which the inner membrane 122 contacts the outer membrane 124 and the pressure at which the inner membrane 122 fully engages the outer membrane 124, there is a more complex relationship between the pressure applied by the cushion 128 and the pressure is the chambers.

Referring to FIGS. 2A and 2D, the contact area of the inner membrane 122 against the outer membrane 152, and thus the diameter of the associated loading area, may be controlled by varying the pressures in the internal and external chambers 130 and 132. As noted, by pumping fluid into the internal chamber 130, the central portion 134 of the inner membrane 122 is forced downwardly and into contact with the outer membrane 124. As the pressure in the internal chamber 130 continues to increase, the diameter of the contact area also increases. Conversely, by pumping fluid out of the internal chamber 130, the central portion 136 of the inner membrane 122 is drawn upwardly and pulled away from the outer membrane 152, thereby decreasing the diameter of the loading area. Moreover, if the support structure 126 is affixed to the inner membrane 122, then further evacuation of the internal chamber 130 can lift the support structure 126 away and out of contact with the outer membrane 124.

Carrier head 100 may also be operated in a "standard" operating mode, in which the internal chamber 130 is vented or evacuated to lift away from the substrate, and the external chamber 132 is pressurized to apply a uniform pressure to the entire backside of the substrate.

Figure 3A:
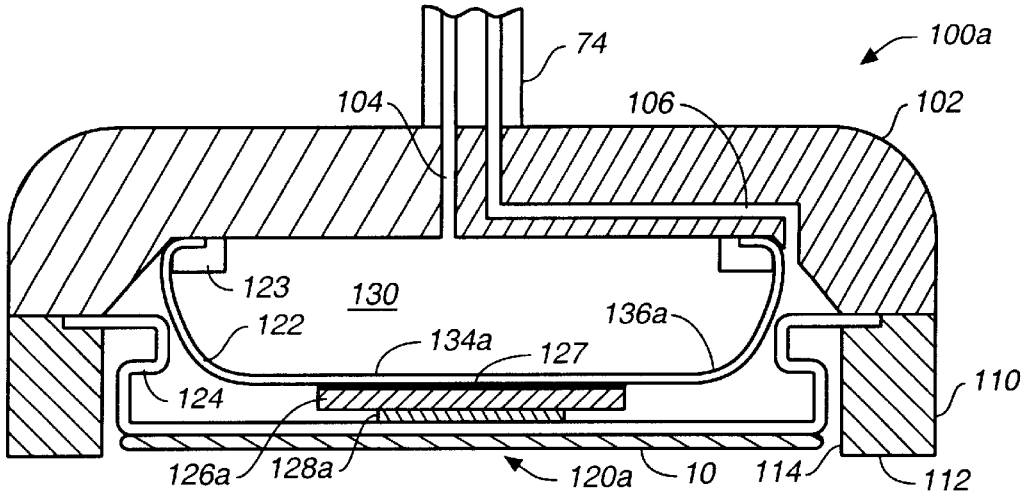
FIG. 3A is a schematic cross-sectional side view of a carrier head that includes a solid center plate.
Figure 3B:
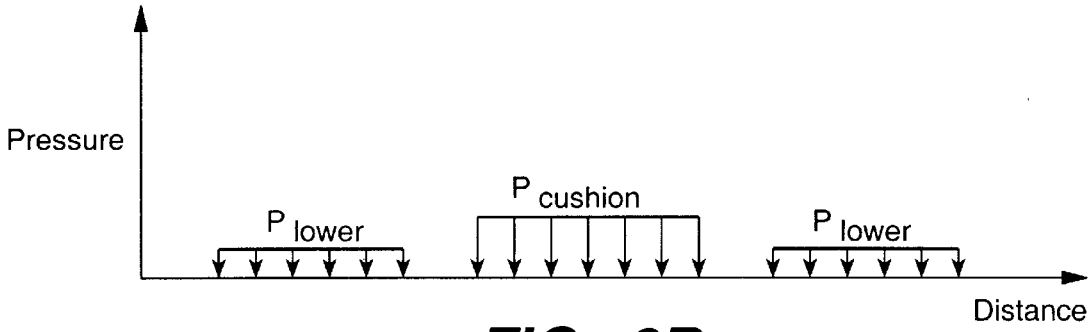
FIG. 3B is graph of an exemplary pressure distribution on the backside of the substrate from the carrier head of FIG. 3A.
Figure 3C:
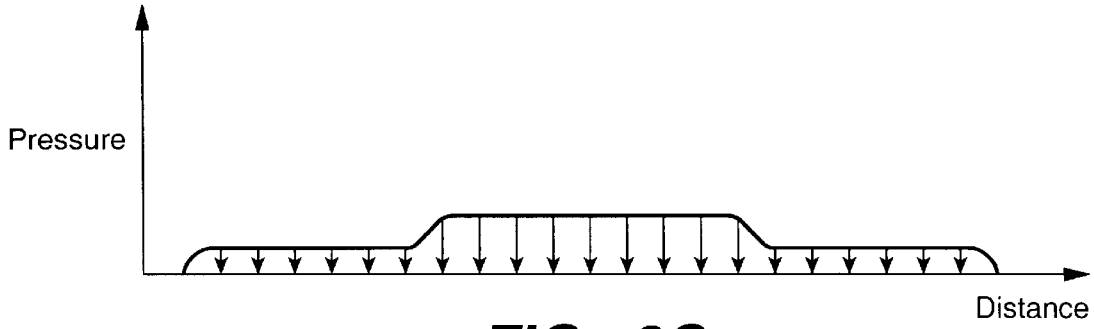
FIG. 3C is graph of an exemplary pressure distribution on the front surface of the substrate from the carrier head of FIG. 3A.

Referring to FIG. 3A, in another implementation, the carrier head 100*a* includes a rigid disk-shaped support structure 126*a* rather than an annular support structure. In this implementation, the cushion 128*a* can also be a solid circular disk-shaped pad located near the center of the substrate. As shown in FIG. 3B, if the pressure in the internal chamber 130 is sufficiently low (relative to the pressure in the external chamber 132), then the inner membrane 122 does not contact the outer membrane 124. However, a center portion 134*a* of the inner membrane 122 does press downwardly on the disk-shaped support structure 126*a*, causing the cushion 128*a* to press downwardly on the upper surface of the outer membrane 124. In this configuration, as shown in FIGS. 3B–3C, a first pressure $P_{cushion}$ is applied to a central region of the substrate where the cushion 128 contacts the outer membrane 124, and the external chamber pressure $P_{lower}$ is applied to the remainder of the substrate. Thus, the carrier head 100*a* can apply different pressures to the substrate in two independent zones, one for the portion of the substrate beneath the cushion 128*a*, and one for the remainder of the substrate. The cushion pressure $P_{cushion}$ can be calculate in a fashion similar to that of the implementation in FIGS. 2A–2C.

Figure 3D:
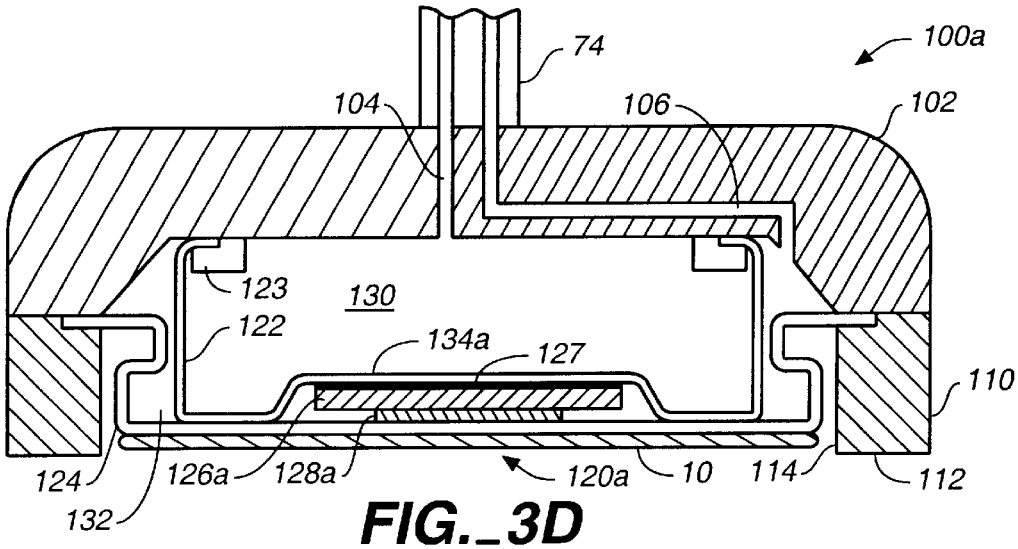
FIG. 3D is a schematic cross-sectional view of the carrier head of FIG. 3A showing the controllable center loading area.
Figure 3E:
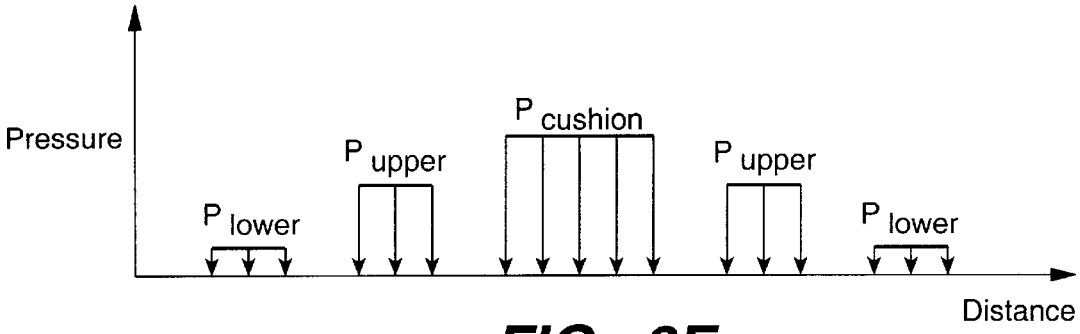
FIG. 3E is graph of an exemplary pressure distribution on the backside of the substrate from the carrier head of FIG. 3D.
Figure 3F:
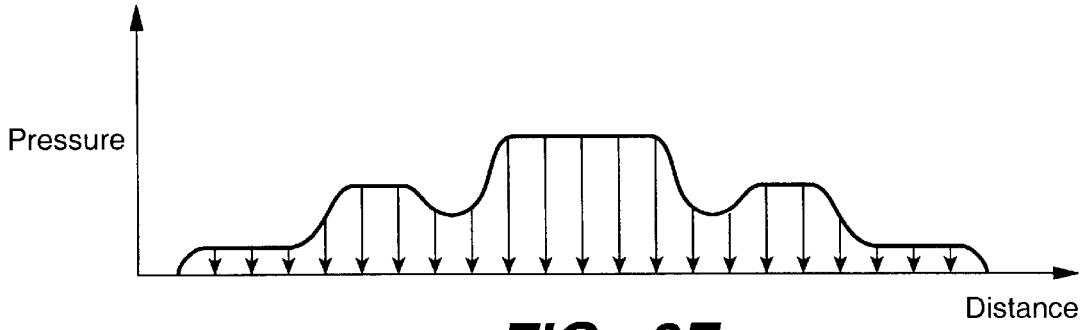
FIG. 3F is graph of an exemplary pressure distribution on the front surface of the substrate from the carrier head of FIG. 3D.

As shown in FIG. 3D, as the pressure in the internal chamber 130 is increased, an annular region 136a of the inner membrane 122 bows downwardly until it contacts the upper surface of the outer membrane 124 in an annular contact area. The resulting pressure distributions are shown in FIGS. 3E–3F. As the pressure in the internal chamber 130 continues to increase, the width of this annular contact area also increases. Thus, in this configuration, the carrier head 100*a* can apply different pressures to the substrate in three independent zones, one for the portion of the substrate beneath the cushion 128*a*, one where the inner membrane 122 contacts the outer membrane 124, and one for the remainder of the substrate. The cushion pressure $P_{cushion}$ can be calculate in a fashion similar to that of the implementation in FIGS. 2D–2F.

Figure 4A:
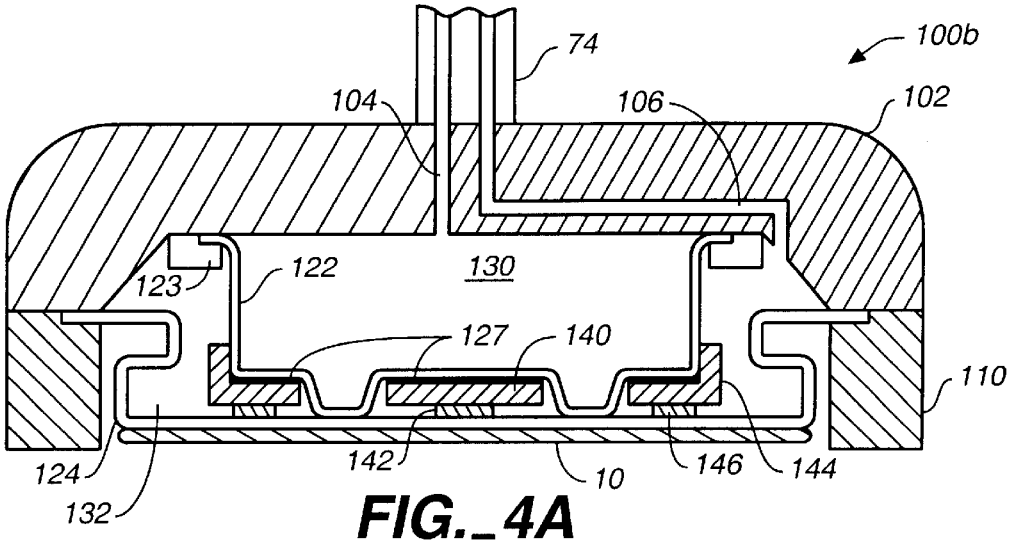
FIG. 4A is a schematic cross-sectional side view of a carrier head that includes a both a solid center plate an annular ring.

Referring to FIG. 4A, in another implementation, the carrier head 100*b* includes both a rigid disk-shaped support structure 140 and an annular support structure 144 surrounding the disk-shaped support structure 140. A disk-shaped cushion 142 can be secured to the disk-shaped support structure 140, and an annular cushion 146 can be secured to the annular support structure 144. The inner membrane 122 presses downwardly on the disk-shaped support structure 140 and the annular support structure 144, causing the associated cushion 142 and 146 to press downwardly on the upper surface of the outer membrane 124 and create two regions of increased pressure on the backside of the substrate. As with the previously described implementations, if the pressure in the internal chamber 130 is sufficiently low (relative to the pressure in the external chamber 132), then the inner membrane 122 does not contact the outer membrane 124. However, as the pressure in the internal chamber 130 is increased, an annular region of the inner membrane 122 bows downwardly until it contacts the upper surface of the outer membrane 124 in an annular contact area.

Figure 4B:
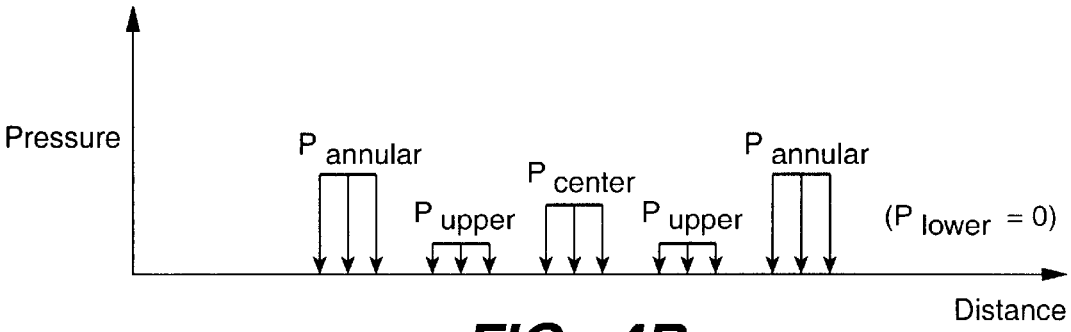
FIG. 4B is graph of an exemplary pressure distribution on the backside of the substrate from the carrier head of FIG. 4A.
Figure 4C:
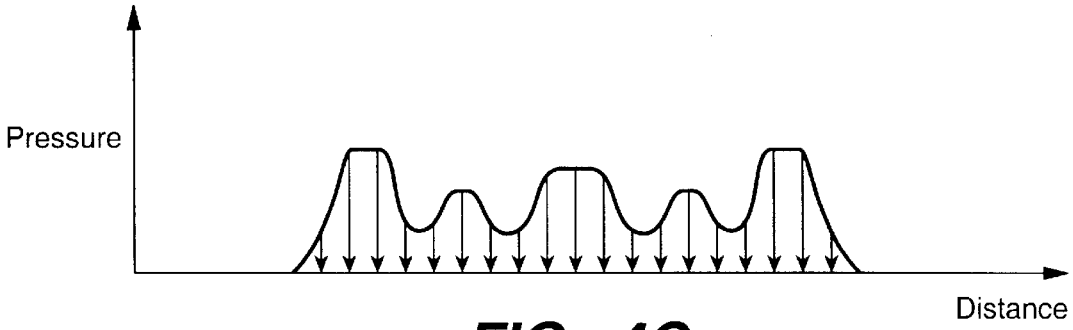
FIG. 4C is graph of an exemplary pressure distribution on the front surface of the substrate from the carrier head of FIG. 4A.

In this configuration, with the external chamber vented or with $P_{lower}$=0, as shown in FIGS. 4B–4C, the carrier head 100*b* applies pressure to three different zones on the substrate. A first pressure $P_{annular}$ is applied to an annular region of the substrate where the annular cushion 144 contacts the outer membrane 124, a second pressure $P_{center}$ is applied to a central region of the substrate where the disk-shaped cushion 140 contacts the outer membrane 124, and a third pressure $P_{upper}$ is applied to another annular region of the substrate where the inner membrane 122 contacts the outer membrane 124. If the external chamber 132 is not vented or a zero pressure, then the carrier head 100*b* effectively applies pressure to four different zones (the fourth zone being the portion of the substrate not covered by the other three zones).

Figure 5A:
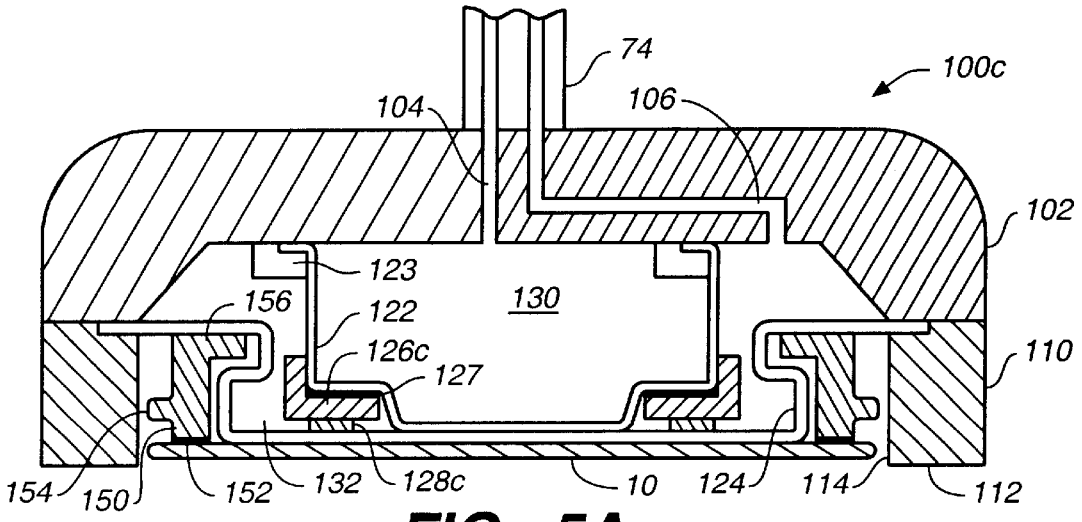
FIG. 5A is a schematic cross-sectional side view of a carrier head that includes an edge load ring.

Referring to FIG. 5A, in another implementation, the carrier head 100*c* includes an edge control ring 150. The edge control ring 150 is a generally annular rigid member positioned between the retaining ring 110 and the outer membrane 124. The edge control ring 150 includes a first flange portion 154 which extends outwardly toward the inner surface 114 of the retaining ring 110 to maintain the lateral position of the external spacer ring and a second flange portion 156 which extends inwardly into the "S-shaped" section of the outer membrane 124. A compressible pad or cushion 152 is secured, e.g., with adhesive, to the bottom surface of the edge load ring 150. The edge load ring functions as described in U.S. patent application Ser. No. 09/200,492, filed Nov. 15, 1998, the entirety of which is incorporated by reference. The pressure $P_{ELR}$ applied by the edge load ring to the substrate is given by the following equation:

$$P_{ELR} = \frac{A_{upper}}{A_{lower}} \cdot P_{lower}$$

where $A_{upper}$ is the surface area of the edge load ring 150 that contacts the outer membrane 124 and $A_{lower}$ is the surface area of the cushion 152 that contacts the substrate 10.

Figure 5B:
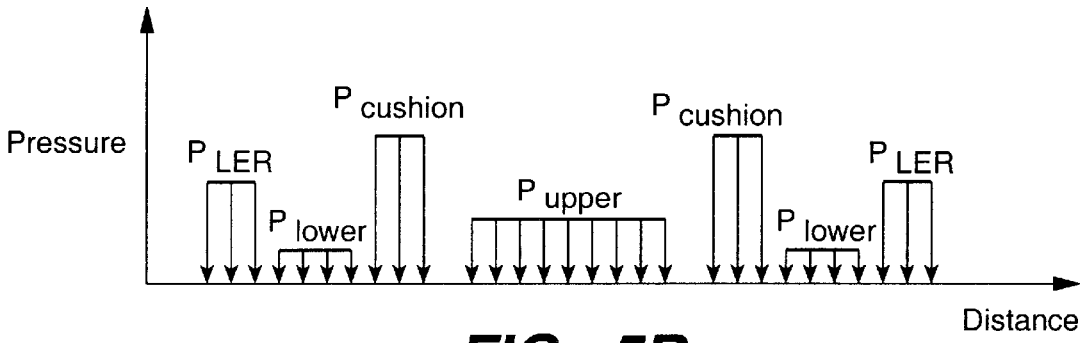
FIG. 5B is graph of an exemplary pressure distribution on the backside of the substrate from the carrier head of FIG. 5A.
Figure 5C:
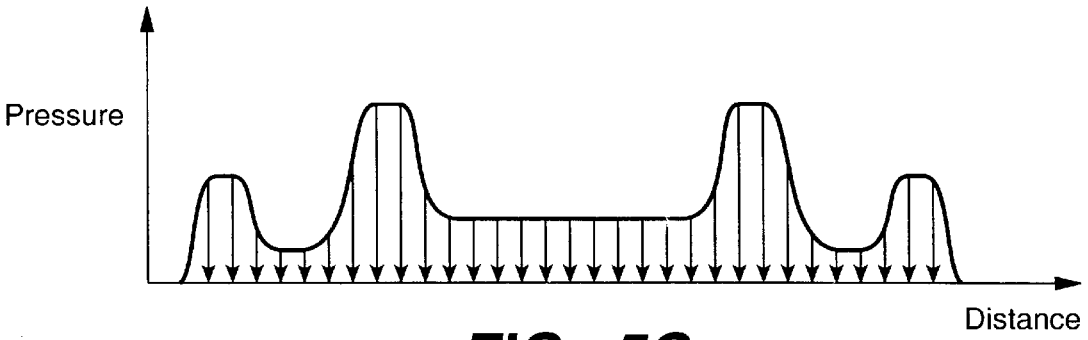
FIG. 5C is graph of an exemplary pressure distribution on the front surface of the substrate from the carrier head of FIG. 5A.

As shown in FIGS. 5B–5C, the carrier head 100*c* applies pressure to four different zones on the substrate. A first pressure $P_{cushion}$ is applied to an annular region of the substrate where the annular cushion 128*c* contacts the outer membrane 124, a second pressure $P_{upper}$ is applied to a central region of the substrate where the inner membrane 122 contacts the outer membrane 124, a third pressure $P_{ELR}$ is applied by the edge load ring 150, and a fourth pressure $P_{lower}$ is applied to the remainder of the substrate by the external chamber 132. Of course, the carrier head could include a disk-shaped support structure rather than an annular support structure. In addition, the carrier head could include a central disk-shaped support structure, an annular support structure surrounding the disk-shaped support structure, and an edge load ring, in which case the carrier head would apply pressure to five different zones on the substrate.

The configurations of the various elements in the carrier head, such as the flexible membranes and the support structure, are illustrative and not limiting. A variety of configurations are possible for a carrier head that implements the invention. For example, the internal chamber can be either an annular or a solid volume. The internal and external chambers may be separated either by a flexible membrane, or by a relatively rigid backing or support structure, or by a combination of flexible and rigid parts.

The present invention has been described in terms of a number of embodiments. The invention, however, is not limited to the embodiments depicted and described. Rather, the scope of the invention is defined by the appended claims.

What is claimed is:

1. A carrier head, comprising:

a housing;

an upper flexible membrane coupled to the housing to define an upper pressurizable chamber; and a pressure distribution assembly positioned below the upper flexible membrane to transfer pressure from a portion of the upper flexible membrane to a more concentrated region of a substrate, said region located interior to a perimeter portion of the substrate.

2. The carrier head of claim 1, wherein the pressure distribution assembly includes a disk-shaped plate.

3. The carrier head of claim 1, wherein the pressure distribution assembly includes an annular ring.

4. The carrier head of claim 1, wherein the pressure distribution assembly includes a disk-shaped plate and an annular ring surrounding the disk-shaped plate.

5. The carrier head of claim 1, further comprising a lower flexible membrane having a substrate mounting surface, wherein both the upper flexible membrane and the pressure distribution assembly contact an upper surface of the lower flexible membrane.

6. The carrier head of claim 5, wherein the pressure distribution assembly includes a disk-shaped plate.

7. The carrier head of claim 5, wherein the pressure distribution assembly includes an annular ring.

8. The carrier head of claim 5, wherein the pressure distribution assembly includes a disk-shaped plate and an annular ring surrounding the disk-shaped plate.

9. The carrier head of claim 5, wherein the pressure distribution assembly includes a rigid member to contact the upper flexible membrane, and a cushion positioned below the rigid member to contact the lower flexible membrane.

10. The carrier head of claim 1, wherein the pressure distribution assembly includes a rigid member to contact the upper flexible membrane, and a cushion positioned below the rigid member.

11. The carrier head of claim 10, wherein the surface area of a lower surface of the cushion is less than the surface area of an upper surface of the rigid member.

12. The carrier head of claim 1, further comprising an edge load ring to contact a perimeter portion of the substrate.

13. A carrier head, comprising:

a housing;

a lower flexible membrane coupled to the housing to define a first chamber, a lower surface of the lower flexible membrane providing a substrate mounting surface;

an upper flexible membrane coupled to the housing to define a second chamber, a portion of the upper flexible membrane biasable into contact with an upper surface of the lower flexible membrane; and a pressure distribution assembly positioned between the upper flexible membrane and the lower flexible membrane, the pressure distribution assembly including an upper surface in contact with the upper flexible membrane and a lower surface in contact with the lower flexible membrane.

14. The carrier head of claim 13, wherein the pressure distribution assembly is configured to transfer pressure from a portion of the upper flexible membrane to a more concentrated region of the lower flexible membrane.

15. The carrier head of claim 13, wherein the pressure distribution assembly includes a disk-shaped plate.

16. The carrier head of claim 13, wherein the pressure distribution assembly includes an annular ring.

17. The carrier head of claim 13, wherein the pressure distribution assembly includes a disk-shaped plate and an annular ring surrounding the disk-shaped plate.

18. The carrier head of claim 13, wherein the pressure distribution assembly includes a rigid member to contact the upper flexible membrane, and a cushion positioned below the rigid member to contact the lower flexible membrane.

19. The carrier head of claim 13, further comprising an edge load ring to contact a perimeter portion of the substrate.

20. A carrier head, comprising:

a housing;

an outer flexible membrane coupled to the housing to define a first chamber, an outer surface of the outer flexible membrane providing a substrate mounting surface;

an inner flexible membrane coupled to the housing to define a second chamber, a first portion of the inner flexible membrane biasable into contact with an inner surface of the outer flexible membrane; and a rigid structure between the outer flexible membrane and the inner flexible membrane, wherein a second portion of the inner flexible membrane applies pressure to an upper surface of the rigid structure, and a lower surface of the rigid structure applies pressure to the inner surface of the outer flexible membrane.

21. The carrier head of claim 20, wherein the rigid structure includes a disk-shaped plate.

22. The carrier head of claim 20, wherein the rigid structure includes an annular ring.

23. The carrier head of claim 20, further comprising a cushion positioned between the rigid member and the outer flexible membrane.

24. The carrier head of claim 23, wherein the surface area of a lower surface of the cushion is less than the surface area of an upper surface of the rigid structure.

* * * * *